United States Patent [19]

DiRegolo et al.

[11] Patent Number: 4,621,743

[45] Date of Patent: Nov. 11, 1986

[54] SELF-SEALING CLOSURE DEVICE

[75] Inventors: Joseph A. DiRegolo, San Leandro; Hugo Hauser, Palo Alto, both of Calif.

[73] Assignee: Tritec Industries, Inc., Mountain View, Calif.

[21] Appl. No.: 735,480

[22] Filed: May 16, 1985

[51] Int. Cl.[4] ..... B65D 39/00

[52] U.S. Cl. ..... 215/308; 215/309; 215/361

[58] Field of Search ..... 215/308, 309, 361, 358, 215/359, 360

[56] References Cited

U.S. PATENT DOCUMENTS

| | | | |
|---|---|---|---|
| 202,138 | 4/1878 | Barthel | 215/359 |
| 3,149,762 | 9/1964 | Decker | 215/309 X |
| 3,750,822 | 8/1973 | Dubach | 215/361 |
| 3,952,902 | 4/1976 | Prouty et al. | 215/308 X |

*Primary Examiner*—Donald F. Norton

*Attorney, Agent, or Firm*—Thomas E. Schatzel

[57] ABSTRACT

A bottle closure device having a stem member with an enlarged top portion, a collar resiliently biased away from the top portion, a retainer member on the end of the stem, and an O-ring between the retainer member and the collar. When the end of the stem is placed within the mouth of a bottle, the biasing means acts to cause the retainer member to press the O-ring radially outward against the collar to form a fluid-tight seal with the mouth of the bottle.

13 Claims, 3 Drawing Figures

SELF-SEALING CLOSURE DEVICE

BACKGROUND OF INVENTION

1. Field of the Invention

The present invention relates to an improved closure device for bottles or similar containers and, more particularly, to a closure device including means to withdraw liquid from the sealed bottle.

2. Description of Prior Art

In the manufacture of integrated microelectronic components, commonly referred to as semiconductor chips, it is imperative to provide carefully controlled processing conditions to maximize the yield of acceptable products. In typical fabrication processes for microelectronic components, a batch of several hundred or more individual semiconductor chips may undergo the same manufacturing process at the same time. Accordingly, any processing upset or error can render useless a large number of potential products. This is especially true, for example, in photolithographic processes where silicon substrates are chemically etched to form topographical patterns which are essential to operation of the microelectronic components.

In conjunction with chemical etching of semiconductor substrates, it is well-known to coat certain portions of the silicon substrate with a thin layer of polymeric liquid known as photoresist. Upon exposure to ultraviolet radiation, the photoresist rapidly solidifies to form a protective layer on the selectively coated portions of the substrate to protect those portions from chemical attack during subsequent etching. Such coatings of photoresist must be continuous over the area to be protected, otherwise a portion of the coated area will undergo etching and the electronic component will likely be rendered valueless. The causes of discontinuities in photoresist coatings have been found to include impurities or particles which are introduced to the process as the photoresist is dispensed from container or reservoir bottles. Accordingly, it is important in the fabrication of semiconductor microelectronic components to minimize the opportunity for particulate impurities to find their way into photoresist liquid.

In a typical microelectronic fabrication operation, photoresist is dispensed periodically by pumping from relatively small bottles. The practice of using small bottles relates to the expense, toxicity and shelf life of the chemical, as well as other factors. Because the individual containers for the photoresist liquid are relatively small, it is necessary to frequently replace the bottles in the dispensing equipment or replenish their contents. Heretofore, the replacement or replenishment operations have often permitted particles to enter the bottles. For example, it has been found that the photoresist may solidfy in the bottles at locations on or near the caps so that, when the cap is removed or replaced, some of the solidified material may flake away and fall into the photoresist liquid. Such flakes may not completely dissolve prior to being pumped out of the bottles and may cause imperfections in the photoresist coatings applied to the microelectronic components.

SUMMARY OF THE INVENTION

A primary object of the present invention is to provide an improved device for sealing bottles to minimize the opportunity for particles to enter the liquid within the bottle when the cap of the bottle is removed or replaced.

An associated object of the present invention is to provide self-sealing bottle closure means for photoresist bottles and the like which minimizes the opportunity for particles to enter the liquid in the bottles.

Yet another object of the present invention is to provide a closure device for bottles containing photoresist or other liquid chemicals, which device includes means to withdraw liquid from the sealed bottles.

In accordance with the preceding objects, the present invention provides a self-sealing closure device having a stem member dimensioned for slidable insertion through the mouth of a bottle and having an enlarged top portion; a collar member having a channel for slidably receiving the stem member; a retainer means secured to the distal end of the stem member and dimensioned to fit within the mouth of a bottle; resilient biasing means disposed about said stem member to urge the collar member toward the retainer means; deformable seal means surrounding the stem member between the collar member and the retainer means such that, with the retainer means inserted within the mouth of a bottle, releasing the biasing means will urge the retainer means toward the collar member and deform the seal means in a radially outward direction to effectuate a fluid-tight seal with the mouth of the bottle; and channel means formed through the stem member to withdraw liquid from the bottle.

Accordingly, an advantage of the present invention is the provision of an improved bottle sealing device to minimize the opportunity for particles to enter the liquid within the bottle when the cap of the bottle is removed or replaced.

A further advantage of the present invention is the provision of an improved bottle closure device for bottles containing photoresist or other liquid chemicals, which device includes means to withdraw liquid from the sealed bottles.

These and other objects and advantages of the present invention will no doubt become obvious to those of ordinary skill in the art after having read the following detailed description of the preferred embodiment which is illustrated in the various drawing figures.

IN THE DRAWINGS

FIG. 1 is a pictorial view of a device according to the present invention in assembled condition; and FIG. 2 is a side view, partially cut away for purposes of illustration, of the device of FIG. 1 inserted into the mouth of a bottle; and FIG. 3 is an exploded view, drawn in section, illustrating the components of the device of FIG. 1 in disassembled condition.

DETAILED DESCRIPTION OF THE PREFERRED EMBODIMENT

Figure 1:
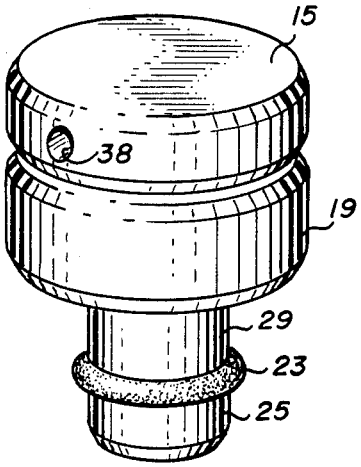
Figure 3:
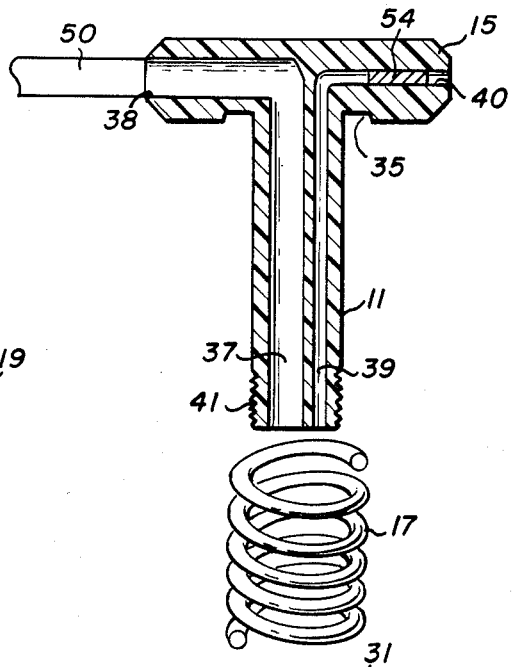
Figure 2:
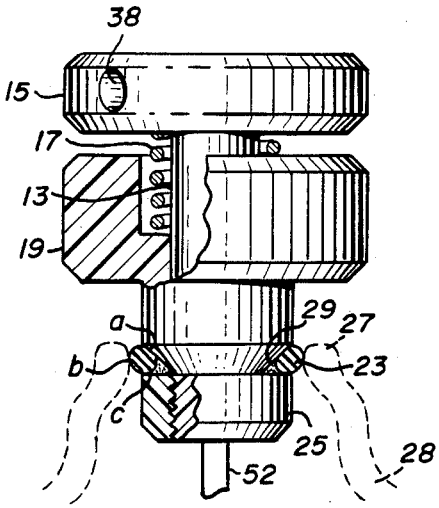

Referring to FIGS. 1 through 3, the self-sealing closure device generally comprises a stem member 11 having an enlarged top portion 15, a helical spring member 17 which is dimensioned to slidably fit around the stem 11, a collar member 19 which is slidably mounted on the stem 11, a retainer member 25 which is secured to the distal end and of the stem 11, and an elastic O-ring which surrounds the stem 11 between the collar member 19 and the retainer member 25. Each of the above-mentioned components is circular in cross-section. The dimensions of the components are primarily determined by the inside diameter of the mouths 27 of the bottle with which the closure member is designed to be utilized. Typically, the inside diameter of the mouth of a bottles utilized to dispense photoresist is one inch; this dimension then determines the maximum outside diameter of the retainer member 25 and the stem 11.

As best shown in FIG. 2, the collar member 19 may have any convenient outside diameter greater than the diameter of the mouth of the bottle with which the closure device will be utilized. Formed axially through the collar member 19 is an open-ended channel 21 which slidably receives the stem member 11. In the preferred embodiment, the end portion 29 of the collar member 19 which faces the retainer member 25 is tapered to have a frustro-conical shape which allows partial insertion of the end portion 29 into the mouth of a bottle. (Referring to FIG. 2, the mouth 27 of a receiving bottle 28 is indicated by dashed lines.) In practice, the angle of the tapered end 29 is about 45° degrees from the axial centerline of the collar member 19; however, such an angle is a matter of design choice and greater or lesser angles could be provided.

In the preferred embodiment, the opposite end portion of the collar member 19 has a circular recess 31 formed therein for seating the helical spring 17. In the preferred embodiment, the outside diameter of the portion of the collar member adjacent the spring 17 is enlarged relative to the tapered end 29 to provide structural strength and to provide a surface which may be readily gripped by hand.

The retainer member 23 may have various configuration as long as it can readily fit through the mouth of a bottle of a chosen diameter. For reasons which will become clear hereinafter, the surface 26 of the retainer member which faces the O-ring 23 should be planar and of substantial width.

The dimensions of the elastic O-ring member 23 are determined both by the internal diameter of the mouth 27 of the bottle 28 and by the diameter of the stem 11. More particularly, the inside diameter of the annulus of the O-ring 23 must be such that the O-ring can, without exceeding the limits of its elasticity, be placed around the stem 11. At the same time, the outside diameter of the O-ring 27 must not be so great as to prevent the O-ring from being readily inserted into the mouth 27 of the receiving bottle when the O-ring surrounds only the stem 11.

The helical spring 17 is a conventional component having a spring force small enough that it can be readily compressed by hand pressure. In practice, a circular slot 35 is formed in the underside of the top portion 15 to seat the upper end of the spring 17.

According to the present invention, two open-ended channels 37 and 39 are formed lengthwise through the stem member 11 without intersecting one another. The purpose of the channels is to allow fluid flow into, or from, the bottle 28. In the preferred embodiment, the first channel 37 has a larger diameter than the second channel, and both channels turn 90° within the top portion 15 so that the channels exit at openings 38 and 40, respectively, at the radial periphery of the top member.

The manner of assembling and operating of the device of the present invention may now be readily understood. In assembled condition, the retainer member 25 is fixedly secured to the distal end of the stem 11, as by mating screw threads 41 and 43. To insert the device into the mouth of bottle 28, the collar member 19 is held steady and the top portion 15 of the stem member 11 is pressed toward the collar member 19, thereby compressing the helicial spring 17 and extending the distal end of the stem 11 away from the tapered end 29 of the collar member 19. With the distal end of the stem 11 so extended, the retainer member 25 and the O-ring 23 can be readily inserted into the mouth 27 of the bottle 28. Once the tapered end 29 of the collar member 19 is partially within the mouth of the bottle, the pressure on the stem member 11 can be released, whereupon the helical spring 17 will force the stem 11 to slidably travel through the collar member 19. As this travel progresses, the distance between the retainer member 25 and the tapered end 29 of the collar member 19 is decreased until the O-ring 23 is pressed against the tapered end portion 29 of the collar member by the planar surface 26 of the retainer member 25. Because of such pressure, which is due to the force of the helical spring 17, the O-ring 23 will be forced to move radially outward on the tapered portion 29 until such time as the O-ring 23 abuts the interior wall of the mouth of the bottle and is no longer capable of further movement or deformation. In this situation, the O-ring 23 forms a circumferential seal with the mouth of the bottle and with the tapered surface 29 of the collar member 19. Also, the O-ring 23 forms a circumferential seal about the planar top of the retainer member 25.

The three circumferential seals are designated "a", "b" and "c" in FIG. 1. The seals "a" and "c" prevent liquid from flowing through any space between the sides of the stem 11 and the channel 21 through the collar member 19. Similarly, the seals "a" and "b" prevent liquid from flowing into the bottle around the closure device. Taken together, the three seals effectuated by the O-ring 23 completely prevents fluid from entering or leaving the bottle except through the channels formed in the closure device.

Once the closure device has been installed upon a bottle, a tube 50 will be connected to opening 38 of channel 37 to withdraw liquid from the bottle, while air or other gas is admitted to the bottle via channel 39. In practice, where relatively tall bottles are employed, an extension tube 52 may be fitted to the lower end of the channel 37 to extend from the channel to the bottom of the bottle. Also in practice, a filter 54 may be fitted to filter air entering the bottle via channel 39 so that the contents of the bottle are not contaminated by air-borne particles.

In practice, the components of the above-described closure device, except for the O-ring 23, are formed of Teflon TM. The O-ring is preferably formed of an acid-resistant rubber.

Although the present invention has been described in terms of the presently preferred embodiment, it is to be understood that such disclosure is not to be interpreted as limiting. Various alterations and modifications will become apparent to those skilled in the art after having read the above disclosure. Accordingly, it is intended that the appended claims be interpreted as covering all alterations and modifications as fall within the true spirit and scope of the invention.

We claim:

1. A self-sealing closure device for use with liquid chemical bottles comprising:

a. a stem member dimensioned for slidable insertion through the mouth of a bottle and having an enlarged top portion;

b. a collar member having a channel formed therethrough for slidably receiving the stem member and having an enlarged top portion which is approximately the same diameter as said enlarged portion of said stem member;

c. retainer means secured to the distal end of the stem member and dimensioned to fit within the mouth of a bottle;

d. resilient biasing means disposed about the stem member between said enlarged top portion and the collar member to urge the collar member toward the retainer means;

e. deformable seal means mounted to surround the stem member between the collar member and the retainer means such that, with the retainer means fully inserted within the mouth of a bottle, releasing the biasing means will urge the retainer means toward the collar member and deform the seal means in a radially outward direction to form a fluid-tight seal with the mouth of the bottle;

f. channel means formed through the stem member from the end of the stem member to the side of said enlarged portion of said stem member for receiving a tube at each end for withdrawing liquid chemicals from the bottle; and wherein the device can be operated by using one hand to securely grasp and squeeze said stem member and collar member together without bending or crushing said tubes.

2. A self-sealing closure device according to claim 1 wherein the surface of the collar member adjacent the retainer member is circular in cross-section and is tapered for partial insertion into the mouth of a bottle.

3. A self-sealing closure device according to claim 2 wherein said tapered surface of the collar member has a frustro-conical shape.

4. A self-sealing closure device according to claim 2 wherein the deformable seal means is an O-ring which is deformed radially outward as it is forced to travel along said tapered surface by the urging of the retainer means.

5. A self-sealing closure device according to claim 4 wherein the surface of the retainer member facing the collar member is planar.

6. A self-sealing closure device according to claim 2, wherein said channel means includes a first-open ended channel formed lengthwise through the stem member to provide a pathway for fluid flow from the bottle.

7. A self-sealing closure device according to claim 6 further including a second open-ended channel formed lengthwise through the stem member, without intersecting said first channel, to provide a pathway for fluid flow into the bottle.

8. A self-sealing closure device according to claim 7 wherein the diameter of said first channel is greater than the diameter of said second channel.

9. A self-sealing closure device according to claim 7 further including a filtering means connected in fluid-flow communication with said second channel for filtering fluid flowing through the channel.

10. A self-sealing closure device according to claim 9 wherein a recessed circular area is formed axially in the collar member to receive and seat said spring.

11. A self-sealing closure device according to claim 1 wherein said resilient biasing means comprises a helical compression spring dimensioned to axially surround the stem member.

12. A self-sealing closure device according to claim 1 wherein the retainer means is threadably received on said distal end of the stem member.

13. A self-sealing closure device according to claim 1 wherein the retainer means and the deformable seal means are both circular in cross-section.

* * * * *